US006029771A

United States Patent [19]

Keown

[11] Patent Number: 6,029,771

[45] Date of Patent: Feb. 29, 2000

[54] COLLAPSIBLE FIRE ESCAPE LADDER WITH ANTI-TIP RESTRAINT SEAT

[76] Inventor: Leslie T. Keown, 1130 Bells Mill Rd., Louisville, Ky. 40165

[21] Appl. No.: 09/243,524

[22] Filed: Feb. 1, 1999

[51] Int. Cl.[7] ..... A62B 1/16

[52] U.S. Cl. ..... 182/7; 182/196

[58] Field of Search ..... 182/3, 6, 7, 70, 182/73, 74, 196

[56] References Cited

U.S. PATENT DOCUMENTS

| | | | |
|---|---|---|---|
| 1,967,767 | 7/1934 | Diez | 182/3 |
| 3,677,366 | 7/1972 | Loeffel | 182/70 |
| 4,298,097 | 11/1981 | Eriksson | 182/198 |
| 5,020,633 | 6/1991 | Rangel | 182/70 |
| 5,022,491 | 6/1991 | Gill | 182/95 |
| 5,467,841 | 11/1995 | Krumal | 182/70 |
| 5,628,380 | 5/1997 | Matisi | 182/70 |

FOREIGN PATENT DOCUMENTS

| | | | |
|---|---|---|---|
| 8911313 | 11/1989 | WIPO | 182/3 |

*Primary Examiner*—Alvin Chin-Shue
*Attorney, Agent, or Firm*—Joseph N. Breaux

[57] ABSTRACT

A collapsible fire escape ladder with an anti-tip restraint seat. The anti-tip restraint seat is attached tD the bottom end of the collapsible ladder and is used to safely lower a person from the upper floor of a building to eliminate the need for carrying the person while descending the collapsible ladder.

1 Claim, 2 Drawing Sheets

COLLAPSIBLE FIRE ESCAPE LADDER WITH ANTI-TIP RESTRAINT SEAT

TECHNICAL FIELD

The present invention relates to collapsible fire escape ladders for escaping from an upper floor window of a building and more particularly to a collapsible fire escape ladder with an anti-tip restraint seat that is attached to the bottom end of the collapsible ladder and used to safely lower a person from the upper floor of a building to eliminate the need for carrying the while descending the collapsible ladder; the collapsible ladder including two flexible side rails supporting a number of spaced, rigid ladder rungs, the collapsible ladder having a top end securable to a building mounting device, such as a rigid cross bar mounted within a ladder storage compartment formed within the building wall, and a bottom end secured to the anti-tip restraint, seat; the anti-tip restraint seat including a flame resistant fabric support seat at cached to the lowest rung of the ladder with two back harness straps and a front harness portion including a V-shaped head passage portion that prevents the anti-dip restraint seat tipping attached to the bottom ladder rung at each of the two top corners by left and right top strap section and to the front top edge of the of the support seat with a front coupling strap section including a two-part coupling mechanism. The anti-tip restraint seat is attached, within the scope of the invention taught herein, by any conventional attachment means either between a strap and the lower rung or a strap and the anti-tip restraint seat; the attachment means including but not limited to clips, screw shut D-rings, squeeze shut D-rings, stitching, double lobster claw fasteners, spring steel closure clips, metal rings, nuts and bolts, rivets, and other fastener mechanism and means that accomplish the function of securing permanently or detachably the anti-tip restraint seat to the bottom ladder rung.

BACKGROUND ART

It can be dangerous for an adult with another person to escape from an upper floor of a building in an emergency, such as a fire, using a collapsible ladder deployed through one of the building windows because carrying the other person while attempting to descend the collapsible ladder can result in falls and other tragic accidents causing injuries. It would be a benefit, therefore, to have a collapsible fire escape ladder that included a restraint seat at the bottom end thereof within which the other person could be restrained and lowered safely to the ground to allow the adult to descend the collapsible ladder in as safe a manner as possible after the other person is safely on the ground. Because the restraint seat could tip forward while lowering the other person, needlessly scaring the other person and leading to possible panic, it would be a further benefit to have a collapsible fire escape ladder that included an anti-tip restraint seat to prevent or minimize such tipping.

GENERAL SUMMARY DISCUSSION OF INVENTION

It is thus an object of the invention to provide a collapsible fire escape ladder with a restraint seat attached to the bottom end of the collapsible ladder.

It is a still further object of the invention to provide a collapsible fire escape ladder with anti-tip restraint seat that includes a collapsible ladder arid an anti-tip restraint seat; the collapsible ladder including two flexible side rails supporting a number of spaced, rigid ladder rungs, a top end securable to a building mounting device, such as a rigid cross bar mounted within a ladder storage compartment formed with in the building wall, and a bottom end secured to the anti-tip restraint seat; the anti-tip restraint seat including a flame resistant fabric support seat attached to the lowest rung of the ladder with two back harness straps and a front harness portion including a V-shaped head passage portion that prevents the anti-tip restraint seat tipping attached to the bottom ladder rung at each of the two top corners by left and right top strap sections and to the front top edge of the of the support seat with a front coupling strap section including a two-part coupling mechanism.

It is a still further object of the invention to provide a collapsible fire escape ladder with anti-tip restraint seat that accomplishes some or all of the above objects in combination.

Accordingly, a collapsible fire escape ladder with anti-tip restraint seat is provided. The collapsible fire escape ladder with anti-tip restraint seat includes a collapsible ladder and an anti-tip restraint seat; the collapsible ladder including two flexible side rails supporting a number of spaced, rigid ladder rungs, a top end securable to a building mounting device, such as a rigid cross bar mounted within a ladder storage compartment formed within the building wall, and a bottom end secured to the anti-tip restraint seat; the anti-tip restraint seat including a flame resistant fabric support seat attached to the lowest rung of the ladder with two back harness straps and a front harness portion including a V-shaped head passage portion that prevents the anti-tip restraint seat tipping attached to the bottom ladder rung at each of the two top corners by left and right top strap sections and to the front top edge of the of the support seat with a front coupling strap section including a two-part coupling mechanism.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
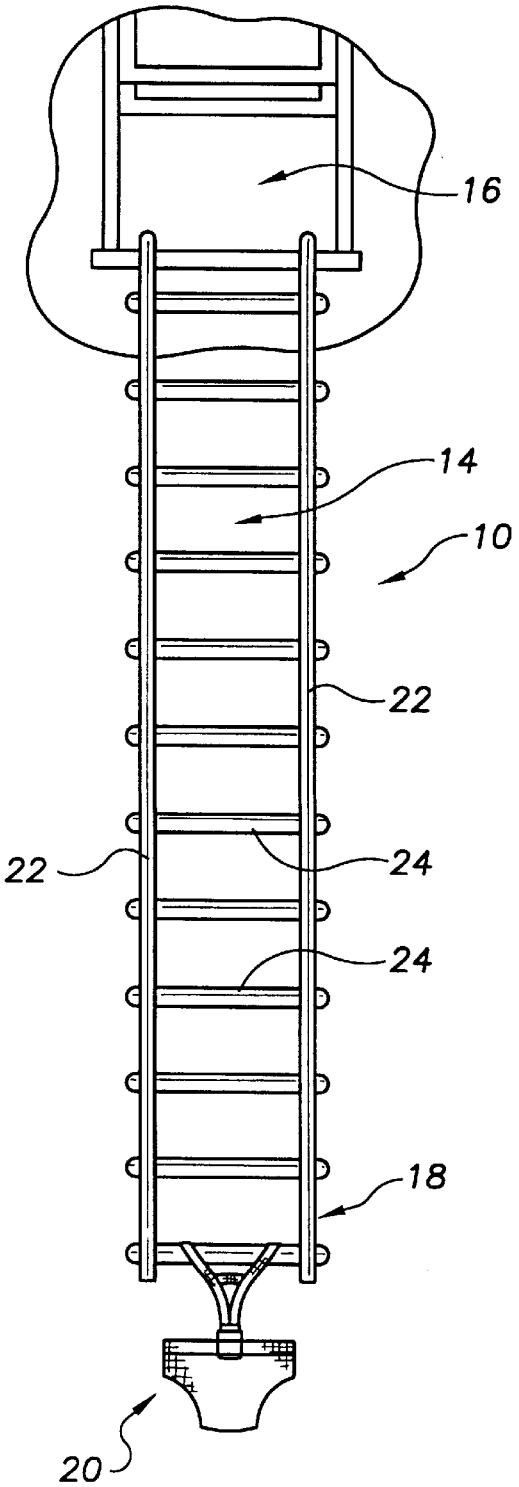
FIG. 1 is a front plan view showing an exemplary embodiment of the collapsible fire escape ladder with anti-tip restraint seat of the present invention showing a portion of the collapsible ladder including two flexible side rails supporting a number of spaced, rigid ladder rungs and extending from a representative upper story window of a building and the anti-tip restraint seat attached to the bottom end of the collapsible ladder.

FIG. 1 shows an exemplary embodiment of the collapsible fire escape ladder with anti-tip restraint seat of the present invention, generally designated 10, with a portion of the collapsible ladder, generally designated 14, extending from a representative upper story window, generally designated 16, and a bottom end 18 attached to an anti-tip restraint seat, generally designated 20. collapsible ladder 14 includes two space de flexible side rails 22 that are attached to and support a number of spaced, rigid ladder rungs 24.

Figure 2:
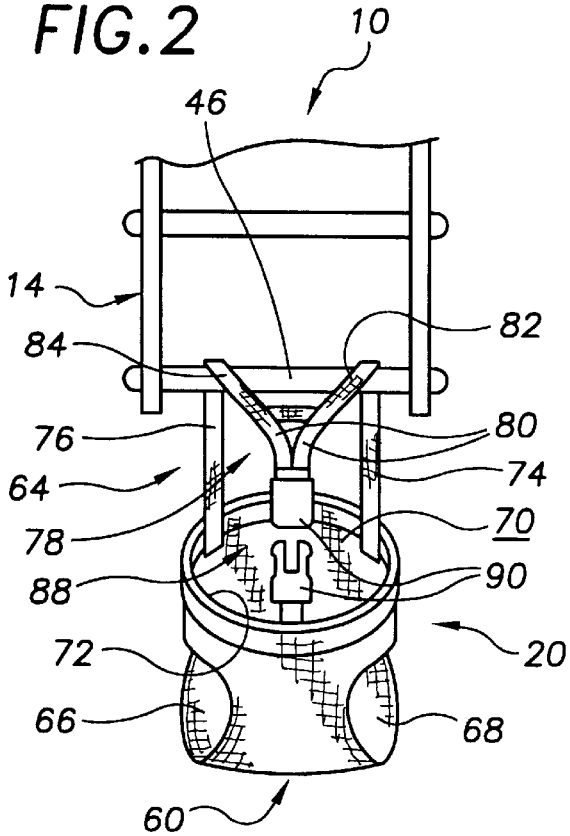
FIG. 2 is a perspective view of the bottom end of the collapsible ladder in connection with the anti-tip restraint seat showing flame resistant fabric support seat attached to the lowest rung of the ladder with two back harness straps and a front harness portion including a V-shaped head passage portion that prevents the from tipping attached to the bottom ladder rung at each of the two top corners by left and right top strap sections and to the front top edge of the of the support seat with a front coupling strap section including a two-part coupling mechanism.

Referring now to FIG. 2, side rails 22 at bottom end 18 of collapsible ladder 14 are secured to anti-tip restraint seat 20. Anti-tip restraint seat 20 includes a flame resistant fabric support seat, generally designated 60, that is attached to lowest ladder rung 46 of collapsible ladder 14 with a harness assembly, generally designated 64. Flame resistant fabric support seat 60 is constructed from a sturdy flame resistant canvas, or similar material, and includes two leg openings 66,68 and a waist opening 70 defined by an upper edge 72. Harness assembly 64 includes two back harness straps 74,76 and a front harness portion, generally designated 78, including a V-shaped head passage portion 80 for preventing the anti-tip restraint seat tipping that is attached to bottom ladder rung 46 at each of the two top corners by left a nd right top strap sections 82,84 and attached at a bottom corner to a front portion of top edge 72 of the support seat 60 with a front coupling strap section assembly 88 that includes a two-part coupling mechanism 90.

Figure 3:
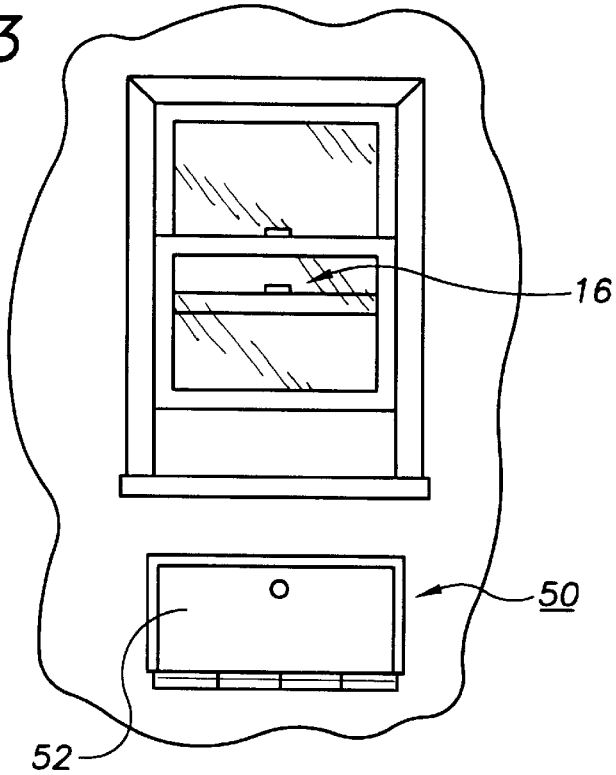
FIG. 3 is an interior view of a representative building having the exemplary embodiment of the collapsible fire escape ladder with anti-tip restraint seat of the present invention installed and stored within a wall compartment provided beneath a representative window assembly showing the wall compartment access door in the closed position.
Figure 4:
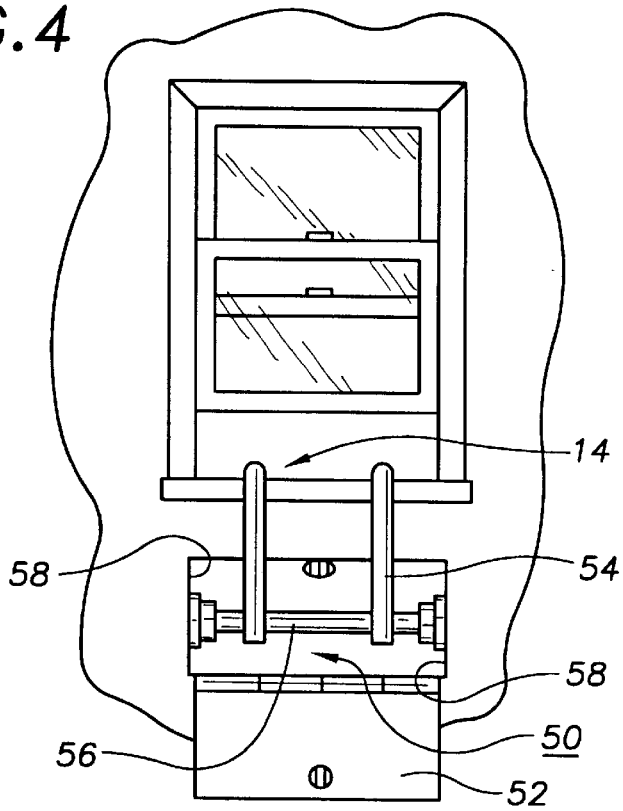
FIG. 4 is a second interior view of the representative building of FIG. 3 showing the wall compartment access door of the wall compartment opened and the ladder removed from the storage compartment and positioned over the window sill and out through the opened window, the top end of the collapsible ladder being secured to a rigid cross bar rigidly mounted within the wall compartment.

With reference to FIG. 3, when exemplary collapsible fire escape ladder with anti-tip restraint seat 10 (FIG. 1) is not needed, It is stored within a wall compartment 50 provided beneath window assembly 16. Wall compartment 50 is sealed by a pivoting wall compartment access door 52. Referring to FIG. 4, a top end of collapsible ladder 14 is secured to a rigid cross bar 56 that is rigidly attached to the sidewalls 58 that partially define wall compartment 50. Generally referring to FIGS. 1–4, in use, collapsible fire escape ladder with anti-tip restraint seat 10 is retrieved from wall compartment 50 and a is seated in foldable seat assembly 26 and waist restraint belt assembly 28 and anti-tip belt 30 are then secured in place prior to lowering the to the ground through window 16. The adult can then climb down collapsible ladder 14 without the need or danger of carrying the in his/her arms.

It can be seen from the preceding description that a collapsible fire escape ladder with anti-tip restraint seat has been provided that includes a restraint seat attached to the bottom end of the collapsible ladder; that includes a restraint seat attached to the end of the collapsible Ladder that includes an anti-tip mechanism for minimizing tipping of the restraint seat while it is lowered from an upper floor of a building; and that includes a collapsible ladder and an anti-tip restraint seat; the collapsible ladder including two flexible side rails supporting a number of spaced, rigid ladder rungs, a top end securable to a building mounting device, such as a rigid cross bar mounted within a ladder storage compartment formed within the building wall, and a bottom end secured to the ant-tip restraint seat; the anti-tip restraint seat including a flame resistant fabric support seat attached to the lowest rung of the ladder with two back harness straps and a front harness portion including a V-shaped head passage portion that prevents the ant-tip restraint seat tipping attached to the bottom ladder rung at each of the two top corners by left and right top strap sections and to the front top edge of the of the support seat with a front coupling strap section including a two-part coupling mechanism.

It is noted that the embodiment of the collapsible fire escape ladder with anti-tip restraint seat described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A collapsible fire escape ladder with anti-tip restraint seat comprising:

a collapsible ladder; and an anti-tip restraint seat;

said collapsible ladder including two flexible side rails supporting a number of spaced, rigid ladder rungs including a bottom ladder rung at a bottom ladder end of said collapsible ladder, and a top end securable to a building mounting device;

said anti-tip restraint seat including a flame resistant fabric support is seat that is attached to said bottom ladder rung of said collapsible ladder with a harness assembly;

said flame resistant fabric support seat including two leg openings and a waist opening that is defined by an upper edge;

said harness assembly including two back harness straps attached at spaced locations to the upper edge at a rear portion of the seat and extending upwardly to right and left top strap sections which loop over said bottom rung adjacent respective corners defined by the side rails and said bottom rung in supporting the seat from bottom rung, a front harness portion;

said front harness portion including said right and left top strap sections extending downwardly and being joined together at their ends forming a V-shaped front harness strap section, a front cross strap parallel to said bottom rung extending across and attached to a top portion of said V-shaped front harness strap section, said front cross strap and said V-shaped front harness strap section defining a V-shaped head passage portion for receiving therethrough during use a head and neck of a child positioned within said anti-tip restraint seat and thereby preventing said anti-tip restraint seat from tipping, a two-part coupling mechanism having a first part connected to the joined ends of the front harness strap section and a section part attached to the upper edge at a front central portion of the seat connecting the front harness strap section to the seat.

* * * * *